United States Patent [19]

Jannone

[11] 4,133,484

[45] Jan. 9, 1979

[54] APPARATUS FOR SPRAYING LIQUIDS IN MONO-DISPERSED FORM WITH CAPACITY TO CONTROL THE QUANTITY OF SPRAY

[76] Inventor: Joseph Jannone, 133-48 84th St., Ozone Park, N.Y. 11417

[21] Appl. No.: 693,790

[22] Filed: Jun. 7, 1976

[51] Int. Cl.[2] ..... B05B 3/02

[52] U.S. Cl. ..... 239/214.25; 261/92; 123/138

[58] Field of Search ..... 123/32 EA, 138; 261/92; 101/147, 425; 239/214.25, 562; 427/348

[56] References Cited

U.S. PATENT DOCUMENTS

| | | | |
|---|---|---|---|
| 2,047,759 | 7/1936 | Wingert | 261/92 |
| 2,174,935 | 10/1939 | Darling | 261/92 |
| 2,246,876 | 6/1941 | Carver | 261/92 |
| 2,928,238 | 3/1960 | Hawkins, Jr. | 239/562 |
| 3,063,868 | 11/1962 | Brandsma et al. | 427/348 |
| 3,143,065 | 8/1964 | Warczak | 101/147 |
| 3,231,415 | 1/1966 | Grenley et al. | 427/348 |
| 3,411,718 | 11/1968 | Wagner | 261/92 |
| 3,758,086 | 9/1973 | Pugh | 261/92 |
| 3,835,779 | 9/1974 | Ross et al. | 101/425 |
| 3,893,434 | 7/1975 | Thatcher et al. | 123/32 EA |
| 3,938,468 | 2/1976 | Kirschner | 427/348 |
| 3,971,354 | 7/1976 | Luchaco et al. | 123/32 EA |
| 3,988,988 | 11/1976 | Sable | 101/425 |

*Primary Examiner*—Samuel Feinberg

[57] ABSTRACT

The invention described herein relates to a liquid spraying device capable of producing minuscule particles of liquid in a uniform pattern by having a thin material movably mounted for causing it to be continuously conveyed through a liquid, the material further having openings in its surface, by way in which constructed or processed, for transporting the liquid in film form. As the material emerges from this liquid, its surface being of such characteristics by shape and size of the openings and the material from which formed that, stressed free liquid films are caused to form in the openings thereof. Under certain conditions surface film will appear on the surface of the material which prevents the formation of free films. Means are therefore provided for removing this unwanted surface film in such a way that free films are caused to form in the openings of the affected portion. The free films are then transported by the material to a gas stream directed across these films to further stress and cause same to rupture with the effects of thus producing the uniform and minuscule particle spray. The quantity of spray can be controlled, when so desired, by the speed at which the material moves and by other means.

12 Claims, 10 Drawing Figures

APPARATUS FOR SPRAYING LIQUIDS IN MONO-DISPERSED FORM WITH CAPACITY TO CONTROL THE QUANTITY OF SPRAY

This invention is concerned with the dispersion of a liquid in a gaseous medium and with an apparatus for affecting such dispersion in a spray having special characteristics, same closely resembling those characteristics associated with a mist. In particular, this invention is directed to apparatus capable of carrying out the method of dispersing liquids into a gaseous medium and of controlling the quantity of liquid dispersed.

This invention has application and utility in a variety of environments, some of which are chemical and food processing, metal lubrication, atmospheric humidification, fuel atomization, chemical treatment by absorption, and the like. In general, the invention has utility in any area wherein it is desired to disperse a fluid in the form of an extremely fine spray into a gaseous medium.

A liquid is atomized when it has been broken up into many small particles. In this condition a given quantity of liquid represents a large amount of surface and can be rapidly vaporized or deposited for coating purposes. Rapid vaporization is essential in many areas, such as atmospheric humidification, fuel atomization, and the like. The formation of an air-fuel mixture consists in atomizing the fuel and mixing the finely divided particles of fuel with air. The ideal situation would be to have all the particles vaporized and uniformly distributed before the mixture enters the combustion chamber. It is with many spraying and jet devices, including the common automobile carburetor, that this condition of uniformly divided fine particle size falls far short of the ideal situation.

In addition to the desirability of producing a mono-dispersed spray of minuscule droplets, there are definite applications where quantity control is also desirable and in some cases essential. The automotive carburetor represents one such application, where the required air-fuel ratios and quantity delivered can rapidly change. Such different air-fuel mixture proportions are required under conditions of idling, economy (cruise) range, high load or full power range, and transient operations such as acceleration and deceleration. Under any of these conditions, it has always been a major problem with liquid fuels to discourage large droplets and corresponding surface films. The carburetor delivers into the air stream a metered amount of fuel which forms a mixture that is made up of air, vaporized and atomized fuel, and liquid fuel. Gases and atomized fuel travel through the manifold at a high velocity relative to the liquid fuel, which flows as a surface film on the manifold walls. Under such conditions, fuel is being wasted as not all of it is vaporized to give the correct air-fuel ratio needed for combustion. At the same time the fuel received by each cylinder will not necessarily have the same composition as the fuel in the carburetor, due mainly to partial vaporization and poor distribution. When the air-fuel ratio is different from cylinder to cylinder, some (or all) cylinders will not receive the optimum ratio for maximum power, or that for minimum fuel consumption, or that for minimum exhaust gas pollutants, depending on which optimization condition of the design was under evaluation. A homogeneous mixture will ensure complete combustion with the corresponding beneficial results of "clean" exhaust and good economy. Thus a mixing problem of fuel and air is always present in such applications.

The present invention, then, lends itself ideally to solving those problems as detailed above, since such a device would not only control particle size and quantity delivered, but would also greatly aid in distributing the particles uniformly.

The invention has application in all of these areas and others, where particle size, shape, and quantity delivered is desirable.

The object of this invention, then, is an apparatus capable of producing a spray having the characteristics of a mist.

Another object of the invention is to produce a spray device capable of dispersing a liquid into a gaseous medium and to control, over a wide range, the quantity of spray dispersed while retaining all the characteristics of a mist.

Still another object of the invention is to produce a spray device capable of quickly changing the rate of spray dispersed over a wide range of dispersion rates.

A further object of the invention is to produce a spray device possessing mechanical and operating simplicity.

Still a further object of the invention is to produce a spray device having general application in a variety of areas of utility, and for a large variety of fluids. An additional object of the invention is to produce a spray device capable of metering and atomizing the liquid fuel of an automotive engine for improving its fuel economy and for lowering its exhaust gas pollutants.

These and other objects of the invention, not specifically referred to but inherent therein, may be accomplished by a mono-layer "porous" material comprising one of the general classes of mono-layer permeable materials characterized by screens, nets, perforated sheets and forms, filters, fabrics, sieves, and the like, wherein said material is in a form having a portion thereof disposed within and in contact with a liquid in a reservoir and adapted to be movably mounted for conveying said liquid in film form from said reservoir to an impinging gas stream; means for supplying liquid to said reservoir so as to maintain contact with said material; means comprising the characteristics of said material acting on the liquid to form thin, stressed free films in the openings of said material upon emerging devoid of surface film from the liquid in the reservoir and upon removing surface film from the exposed "porous" material when found to exist thereon; means providing for the removal of surface film when in existence so that only free films encounter said gas stream; means for introducing a gaseous medium to the interior of a gas emitter at a pressure above ambient pressure acting on the outside of said emitter whereby said medium is emitted outwardly from the interior thereof as said gas stream and directed transverse to one side of the moving free films with sufficient energy to rupture said films, thereby producing minuscule droplets of liquid which are dispersed into the gaseous medium in the form of a finely suspended spray having uniform distribution; wherein the quantity of liquid spray dispersed depends upon the speed of the "porous" material and the width of the gas stream.

Directing attention now to the drawings appended hereto and forming a part of this disclosure, several simple forms of the apparatus and modifications thereof are illustrated and described as a means of practicing the invention. It should be noted, however, that the present invention is by no means limited to the forms illustrated, but it is contemplated that considerable variation may be made in the selection of the "porous" material, its gross surface form, the method of obtaining an impinging gaseous stream and of removal of surface film, without departing from the spirit of the invention.

Figure 1:
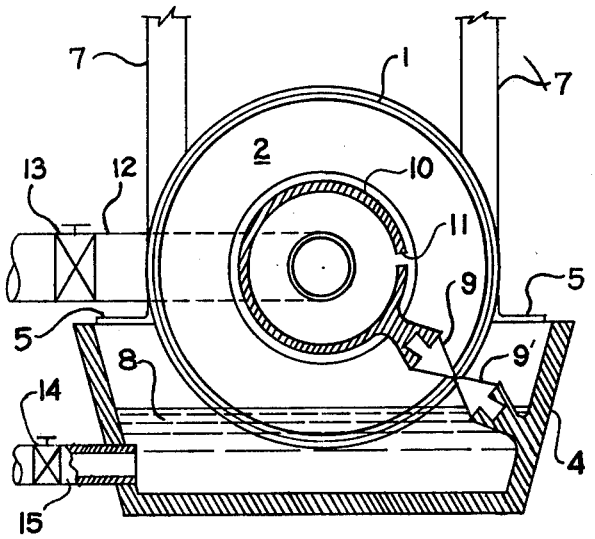
FIG. 1 illustrates a simple means of practicing the invention: shown in section.
Figure 2:
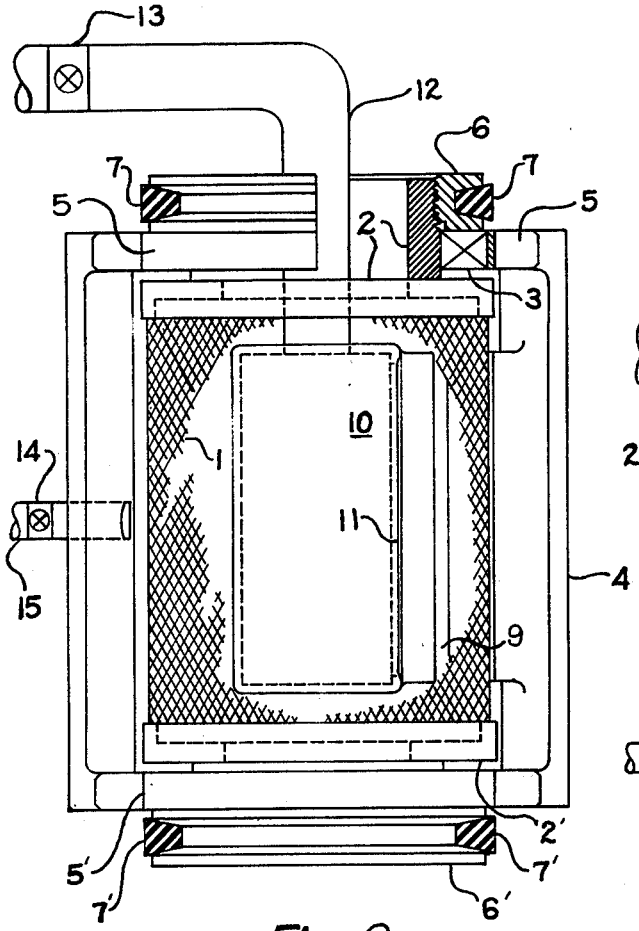
FIG. 2 is a plan view of the device shown in FIG. 1.

Directing attention to FIGS. 1 and 2, the mono-layer "porous" material 1 gross surface shape has the form of a cylinder in this simple means of practicing the invention. Said "porous" material is supported by two cylindrically shaped end flanges 2,2' and connected to said flanges by any suitable means. Said flanges are in turn supported and made rotatable by some suitable "frictionless" bearing 3 held in position by the receptacle or reservoir 4 and mounting collars 5,5'. Said collars are secured to the receptacle 4 by any suitable means and can be utilized to facilitate installation of the rotating "porous" material assembly.

As the "porous" material can be fabricated of non-rigid materials which are incapable of self supporting the cylindrical gross surfaceshape (e.g., nylon and Saran fabrics), it becomes necessary in such cases to maintain some degree of tension in the axial as well as the circumferential directions. The flanges 2,2' can obviously be used to apply and maintain circumferential tension. A rather simple means for maintaining axial tension is shown by the partial half section in FIG. 2. It can be seen that the smaller cylindrical portion of the flange 2 is partially threaded on its outer surface to accept the pulley thrust washer 6, also threaded. By tightening up on the thrust washers 6,6', the flanges 2,2' are caused to move outwards with the effect of applying and maintaining axial tension on the "porous" material 1; hence the cylindrical gross surface shape is maintained.

When plain bearings (sliding contact) are used, the pulley thrust washers 6,6' would act against and slide over the annular surface of these bearings. However, if bearings with rolling contact are used, the thrust washers would act against and rotate with the bearing race in contact with the flanges so that there would not be any sliding between these two elements. Also, a loose or sliding fit would be maintained between the flange's bearing surface and the bearing's inner race in order to apply axial tension adjustments.

For the same type of flexible "porous" materials discussed above, i.e. those materials incapable of self supporting the prescribed gross surface contour, any circumferential strain or twisting may cause it to deform in such amount that it will hinder the formation of free liquid films within its openings. It is therefore desirable to impart the same rotation to both flanges 2,2' simultaneously.

Rotation can be achieved, if desired, by drive pulleys 7,7' having a common drive (not shown). It is shown in FIG. 2 that the pulley thrust washers 6,6' possess a tapered groove on their outer surface which is used for positive seating of the drive pulleys 7,7'.

As the "porous" material 1 travels in its circular path, its lower portion is conveyed through a liquid 8 contained by the receptacle 4. When emerging from this liquid, thin, stressed free liquid films are formed in its openings wherever liquid surface film does not adhere to, or form on, the surface of said material. That portion containing surface film thereon must now be removed; hence the mechanical wipers 9,9' shown in FIG. 1. One of the wipers is supported by the receptacle 4 while the other by the plenum chamber 10, and function to remove any surface film contained on the "porous" material traversing said wipers. Surface film removal by such means is effectuated by preventing said film from passing between wiper and "porous" material, in the same way that a conventional automobile windshield wiper blade prevents water film from passing between it and the windshield. While the wipers 9,9' make contact with the "porous" material, it has been found that they do not interfere with the passage of free liquid films existing in the openings of said material.

While the mechanical wipers 9,9' are shown to have a triangular cross-sectional shape, any other shape which is proven effective could be used and, therefore, should not be considered limited to the foregoing shape.

A further form of mechanical wiper as applicable to the apparatus of FIGS. 1 and 2, and possessing a circular cross-sectional shape, comprises two opposing free rotating cylinders (not shown) having their longitudinal axes parallel to the axis of rotation of the "porous" material. Here they would contact opposite sides of the "porous" material surface in the same relative position as that shown by wipers 9,9'. Movement of the "porous" material would cause the cylinders to rotate and thus offer little wear and resistance. With this form of wiper, however, there exists an increased potential for forcing the liquid under and past the rotating wipers. As liquid tends to adhere to a solid surface, the hydrodynamic pressure gradient existing at the point of contact between "porous" material and wiper is now increased due to the rotation of the wipers and this raises the potential for seepage (hydroplaning).

It was found that relatively soft and flexible materials such as rubber and some synthetics possessed the most desirable characteristics for the stationary type wipers while most rigid materials were shown to be effective for the rolling type.

In the process of removal of surface film, liquid remains in the openings of the "porous" material in the form of a thin, stressed free liquid film. After removal of surface film, the free films then encounter an impinging gas stream which is continuously being emitted from the elongated aperture 11 located on the surface of the plenum chamber 10. The interior of the plenum chamber 10 is pressurized above local atmospheric pressure via conduit 12. Said conduit having, if desired, a regulator valve 13 and in communication with the interior of the plenum chamber by any suitable connector. The plenum 10 is used here as a means of maintaining uniform pressure along the length of the aperature 11 in order to obtain a uniform gaseous discharge. The gaseous medium emitting from the aperture 11 is caused to be directed transverse to, and impinge upon, one side (inner surface) of the free liquid films contained in the openings of the "porous" material 1, and possessing sufficient energy to further stress said films to the point of rupture whereby minuscule liquid particles are formed as a consequence thereof. The particles thus produced become entrained in the gaseous medium and are projected outwardly from the surface of the "porous" material. This mist like dispersion will continue indefinitely as long as free films are continuously supplied by the rotating "porous" material to the impinging gaseous medium stream.

The liquid 8 is maintained in the receptacle 4 at a level sufficient for having the lower portion of the "porous" material disposed within said liquid. The maintenance of this liquid level is accomplished by, if desired, a flow regulating valve 14 connected to the liquid supply conduit 15. Conduit 15 is in communication with the receptacle 4 by any suitable connection and with a liquid source at its other end (not shown).

Some common examples of mono-layer "porous" materials are screens, filters, sieves, perforated sheets and forms, nets, and fabrics. Such materials, and the like, may be said to comprise the general classes of mono-layer permeable materials. As a general rule, materials having openings in its surface by way in which constructed or processed, and possessing appropriate characteristics by shape and size of the openings thereof and the material from which formed, shall herein be classified as mono-layer "porous" materials.

It has been observed that very thin pre-stressed films can be obtained in the aforementioned manner. Verticle films have been produced in the laboratory of investigators by submerging a frame into a solution and withdrawing it at a very slow rate (in the order of 500 microns per second). Here, visual observation was essential for studying the draining effects of free films so that most of their work involved films several centimeters in width. These "large" films are relatively unstable so that any small disturbance will cause them to rupture. However, as the width opening of the supporting frame is made smaller, the resistance of the film to rupturing increases. In general the thinner the film upon rupturing the smaller will be the resulting particle size. It has been verified by various investigators that certain films drawn out of solution will have a thickness depending upon the surface tension of the solution, its viscosity, its density, gravity, and velocity of pull-out. It has also been indicated that the thickness of the supporting frame affects the film thickness. It should be emphasized that to the best knowledge of this inventor, previous consideration has not been given to the production of free liquid films as a source for liquid spray in the manner herein disclosed.

In a series of simple experiments utilizing various synthetic and metallic screens, it was observed that by rapidly conveying these screens through a receptacle containing water, only those screens possessing openings in the order of 0.075" and smaller were able to produce films. In addition, of those screens producing films, the ones possessing the larger openings per thread size produced the smaller particle spray. In general then, designing or selecting of the "porous" material for a particular fluid could entail a detailed analysis of some or all of the previously mentioned factors.

Surface tension of a liquid is due to the forces of attraction between like molecules, called cohesion, and those between unlike molecules, called adhesion. In the interior of a liquid, the cohesive forces acting on a molecule due to its neighboring molecules are balanced out since there is some uniform distribution of like molecules surrounding it. Near a free surface, however, since the cohesive force between liquid molecules is much greater than that between say an air molecule and liquid molecule, there exists a resultant force on a liquid molecule acting toward the interior of the liquid. This force, known as surface tension, is what holds the free liquid film together.

At a solid-liquid boundary, a somewhat similar phenomena takes place. Suffice it to say that depending on the liquid and the solid material in communication, there can exist a rise or depression of the liquid surface at this boundary. The liquid surface therefore contacts the solid surface at an angle, measured in the liquid, known as the contact angle. When the contact angle is less than 90 degrees, the liquid is said to wet the wall, in which case the liquid surface in the vicinity of a wall will rise. It is well known that water wets clean glass but mercury does not. By choosing a "porous" material in which the liquid under consideration "wets its walls", the surface of the free liquid film will lie, or be depressed, below the surface of said material. Under these conditions, the wipers of FIGS. 1 and 2 will not make contact with an existing free liquid film and hence avoid premature rupturing of free liquid films.

As the "porous" material emerges from the liquid to be atomized, two distinct liquid forms can exist in separate regions thereof in which surface tension is the responsible mechanism for their formation. In some regions liquid is carried in the openings of the "porous" material in the form of thin, stressed free films, and in other regions liquid is carried on the surface in the form of surface film. This surface film is created as a result of the adhesive forces between the liquid and the "porous" material and can be observed in the form of streamlets or various concentrated shapes. They are held together by cohesive forces and are able to move across the surface of the "porous" material with little difficulty. When surface film is displaced, it is seen that free liquid films occupy the openings of that portion of the "porous" material which was previously occupied by the surface film. It is this phenomenon which allows the removal of surface film and its consequent replacement with free liquid films. A failure to remove this surface film will result in large spray particles and thus defeat the object of the invention.

Still a further phenomenon affecting the creation of surface film is the draining effect of free liquid films. Here the net flow of liquid along and within the film (i.e., the two surfaces and the intralamellar fluid) starts to move toward its borders as soon as it is formed. This motion is due to two different causes. The first is gravity which causes the thinner and therefore lighter masses to move upwards, replacing the ones that are thicker and therefore heavier. The other is the effect of capillary suction at the border where there must always be a curved meniscus (the so-called Plateau border) through which the excess liquid flows by action of gravity. This suction exerts a greater force upon a thick film than upon a thin one, thus causing the thick film to be pulled into the border while the thin film is simultaneously pulled out of the border to replace the loss mass of fluid. In this "Marginal Regeneration" mechanism, the film disproportionates and the excess liquid, originally present in the area whose thickness decreases, is forced into a thickening welt at the border. Under the influence of gravity, this welt of liquid starts to flow. Depending on the thinning rate of the film and the rate of pull-out from the liquid, this draining effect may not be witnessed if the pull-out rate far exceeds the thinning rate. However, if the thinning rate is found to be even remotely close to the pull-out rate, it will be to advantage to allow as much time as possible for thinning before rupturing of the film. The advantage lies in the fact that the thinner the film before rupturing, the smaller will be the resulting particle size. Thus, if one were considering the apparatus of FIGS. 1 and 2 for a liquid whose thinning rate was comparable in magnitude to the pull-out rate (tangential velocity) of the "porous" material 1, the aperture 11 may very well be located somewhere on the opposite side of the plenum chamber 10. This will evidently give appreciably more time for thinning since the free film impregnated "porous" material must now travel over a greater distance (and time span) before reaching the impinging gaseous medium spray which is emitted from the aperture 11.

Depending on the "porous" material being used, mechanical wipers of the type shown and described in FIG. 1 may not be totally effective in preventing the surface film from passing by. In an experimental setup, a nylon filter ("porous" material) with a 124 × 124 mesh and an approximate mesh opening of 0.0044" was tested with a pair of conventional automobile windshield wiper blades. The nylon filter was stretched and clamped between two circular rims. The rims were then mounted on rollers so that it could be made to rotate in a fixed vertical position while at the same time conveyed through water maintained in an open receptacle. It was found that this combination of "porous" material and wiper failed to completely remove the surface film at rotational speeds above a relatively low value. By increasing the contact pressure between wiper and "porous" material, the limiting effective speed was raised. The greater the contact pressure, however, the greater the wear one can expect of the materials. An alternate means for removing surface film and one which was found to give satisfactory results is shown in the apparatus of FIGS. 3 and 4.

Figure 3:
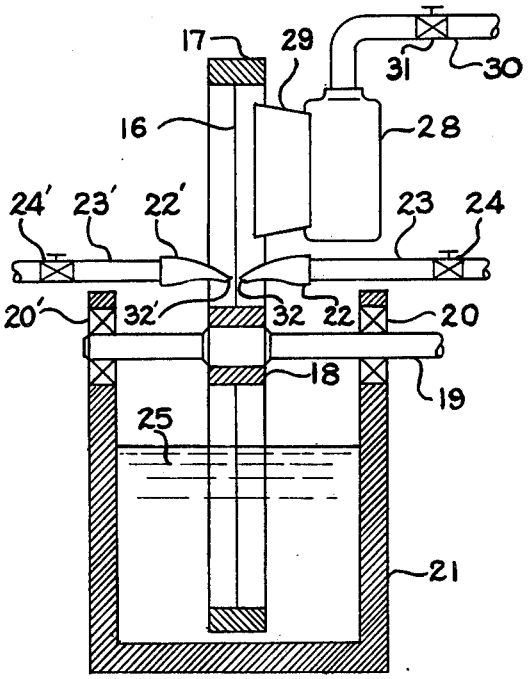
FIG. 3 is a sectional view of a further form of the invention.
Figure 4:
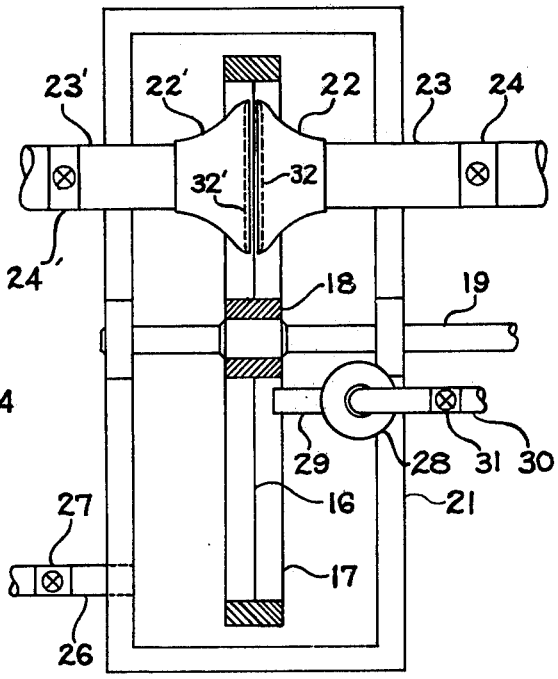
FIG. 4 is a plan view of the device shown in FIG. 3, wherein only the disc shape "porous" material and supporting ring and hub are shown in section.

Turning now to FIGS. 3 and 4, another simple form of the basic apparatus is disclosed. In this version the "porous" material 16 gross surface shape is in the form of a disc, where said "porous" material is supported at its outermost boundary by an annular rim 17 and at its innermost boundary by a hub 18, affixed to said rim and hub by any suitable means. Integral to the hub 18 is a shaft 19 which is made rotatable by any suitable bearings 20, 20' in which the bearings are secured to the receptacle 21 by any suitable means. The shaft 19 is seen to extend beyond one side of the receptacle 21 to allow for some means of connecting an external drive (not shown).

Should it be found that axial twisting of the "porous" material between the annular rim and hub occurs in such amount as to hinder the formation of free liquid films, then it is a simple design change to have the rim rotatably supported and driven so that the need of a hub is eliminated. In this case axial twisting of the "porous" material is virtually eliminated.

In the proximity of the "porous" material's surface, but not in contact with it, is a pair of flared suction nozzles 22, 22' which are connected to conduits 23, 23' by any suitable means and having, if desired, flow regulating valves 24, 24'; said conduits being in communication with a vacuum source (not shown).

The receptacle 21 contains a liquid 25 supplied by a conduit 26 having, if desired, a flow regulating valve 27 for maintaining the liquid 25 at an appropriate level; said conduit being in communication with a liquid source (not shown).

Seen further in FIGS. 3 and 4 is a plenum chamber 28 and a variable exit area nozzle 29 affixed thereto. Said nozzle being in communication with said chamber and containing directional flow vanes therein. Said chamber is in communication with a conduit 30 by any suitable connection and said conduit having, if desired, a flow regulating valve 31 therein. Upstream of conduit 30 and in communication with it is a pressurized gas source (not shown).

As the "porous" material 16 is caused to rotate by means of an external drive, its lower portion is constantly in communication with the liquid 25 to be atomized. Rotation is accomplished by means of imparting rotation to the hub 18 which is securely affixed to the drive shaft 19. As the "porous" material 16 emerges from the liquid 25 in the receptacle 21, liquid is carried in the form of thin, stressed free films, or surface film, or a combination of both. Said material is then seen to encounter a low pressure region (vacuum) created by the suction nozzles 22, 22'. These nozzles function to remove any existing surface film in a manner which is similar to that used by a conventional household vacuum cleaner when it removes lint and dirt from a rug; i.e., the suction created by the nozzles causes the liquid film to separate from the "porous" material surface whence it is drawn into said nozzles.

The nozzles 22, 22' are flared in order to form a long narrow opening 32, 32' at its base and also curve downward to form an acute angle between the plane of the openings 32, 32' and the surface of the "porous" material. It has been found by careful experiments that the direction of the suction nozzles should be at some acute angle for satisfactory and efficient removal of surface film. Directing the plane of the openings 32, 32' parallel to the "porous" material surface results in drawing-off both the surface film and the free film if the suction force and position of the nozzles are not carefully matched on either side. When the plane of the openings 32, 32' are directed perpendicular to the surface, a greater suction force is needed as compared to when placed on an acute angle. It has also been observed that at slow rotational speeds, low vacuum pressures are sufficient to satisfactorily remove all surface films encountering the vicinity of the nozzles. At higher rotational speeds, the vacuum pressure must be increased.

After leaving the vicinity of the suction nozzles where surface film is removed from the "porous" material surface, the free film inhabited "porous" material next encounters an impinging gas stream emitting from the variable flow area nozzle 29. The plenum 28 and nozzle 29 are further shown in section in FIG. 5. It can be seen that the interior of the nozzle 29 contains a pair of directional vanes 33, 33' which pivot about pins 34, 34' by any suitable means in order to change the nozzle exit area. The gas leaving the plenum enters the nozzle 29 which is bounded on top and bottom by the inner contour of the vanes 33, 33'; said vanes function to limit the width of the gas stream as it leaves the nozzle. It should be noted that said vanes need not be limited to only pivotal motion for changing the flow area. The plenum 28 is used here, as in the apparatus of FIGS. 1 and 2, as a means of maintaining uniform pressure (and hence flow) along the length of the nozzle 29.

Figure 5:
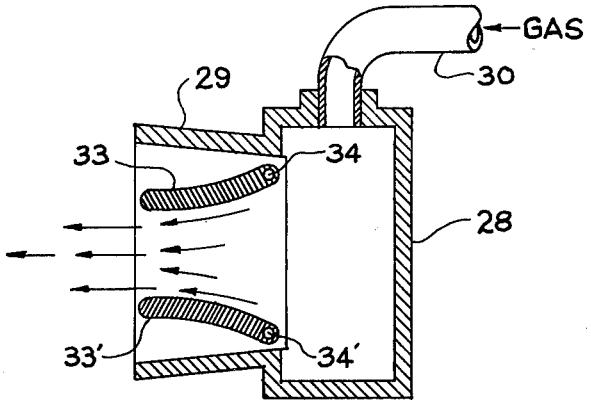
FIG. 5 is a sectional view of the plenum and nozzle of FIGS. 3 and 4, illustrating the directional vanes located within the nozzle contour.

It is seen in FIG. 5 that the emitting gas stream width depends upon the position of the vanes within the nozzle. Said vanes are shown to have a smooth curving profile in order to allow for a smooth transition of the gas flow from entrance to exit. This will avoid flow separation and assures flow conforming to the vane's contour (see arrows in FIG. 5). The emitting unconfined gas stream will then strike the free films transversely and rupture only those films encountering this stream. By changing the position of the vanes within the nozzle will obviously change the percentage of the "porous" material surface encountering said gaseous stream. This therefore allows one means of controlling the quantity of liquid particle spray dispersed.

By controlling the speed of the "porous" material, an additional means is achieved for controlling the quantity of spray dispersed. This means of control is a basic inherent feature of all forms of the invention. By utilizing both means of control, the apparatus will then be capable of operating over a very wide flow range. For example, the variable flow area nozzle can limit the quantity of spray from zero (vanes in full closed position) to that which would be produced by rupturing those free liquid films encountering the maximum gaseous stream width (vanes in full open position). At the same time, the speed of the "porous" material can be limited from a value of zero (no particle spray) to a rated upper limit which can only be determined by tests.

In addition to possessing quantity control, the apparatus has the further capacity to quickly vary the rate of particle dispersion. For example, if the speed of the apparatus were held fixed at its upper limit, then by controlling only the nozzle opening a change from zero to maximum flow can be achieved in the time it takes to fully open the nozzle from a completely closed position. This obviously can occur in a very short time. If the impinging gas stream were emitted from a fixed area aperture, as is done with the plenum chamber 10 of FIGS. 1 and 2, then quantity control would be achieved solely by controlling the speed of the "porous" material. In this case speed changes can also be achieved rather quickly, depending mainly on the response of the external drive. It is obvious, then, that while a combination of both types of control gives the greatest variation in flow rates, it can also achieve rapid flow rate changes within any flow range possible by said combination.

While only two forms of gas emitters are shown and described, namely a plenum chamber 10 having a fixed area aperture and a variable flow area nozzle 29, many other forms of emitters can also be used to accomplish the same effects. For example, a very simple device that can be employed and one which can also control the quantity of particle spray comprises, in combination, a movable deflector vane (or vanes) and a gas emitter having a fixed discharge area. The vane(s) would intercept the impinging gaseous medium stream to cause a percentage of said stream to be deflected away from the "porous" material surface. The percentage deflected would simply depend upon the distance said vanes are moved into said stream. Another employable and simple device comprises a collar or slide having one or a multiple of openings therein to cause the flow area of a fixed discharge area emitter to change when said collar or slide is caused to move over said discharge area. In general, then, any form of gas emitter or device which is capable of controlling the total width of the gaseous medium stream that impinges upon the free liquid films can find application herein.

Figure 6:
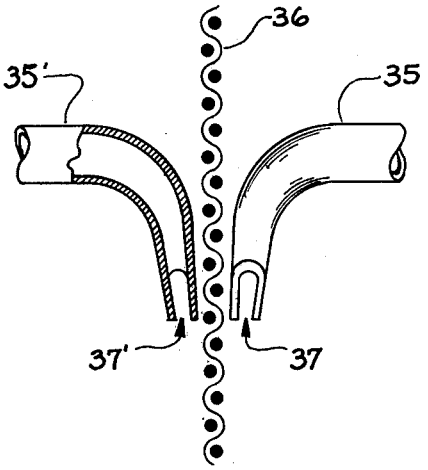
FIG. 6 is a profile view of a further form of the device used for removal of surface film, illustrating a pair of gas emitting nozzles and a portion of the "porous" material which is in close proximity to said nozzles.
Figure 7:
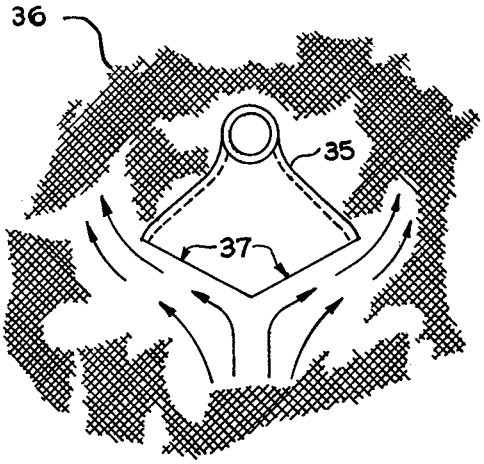
FIG. 7 is a side view of FIG. 6.

Directing attention now to FIGS. 6 and 7, a further means for effecting removal of surface film is shown. In this method of removal, the surface film is caused to be displaced along the surface of the "porous" material by means of a gas stream directed along said material surface. Shown is a partial view of a pair of flared spray nozzles 35, 35' placed in close proximity to the "porous" material 36. While the "porous" material is shown to possess a straight profile form (see FIG. 6), any of the other adaptable geometric forms could also have been shown and the nozzles 35, 35' would then be made in conformity to such profile forms. In particular, FIG. 6 illustrates a profile view of said nozzles and "porous" material where one of the nozzles is shown in section. A normal right side view of FIG. 6 is shown in FIG. 7 where it can be seen that the base of the nozzles 35, 35' possess a "V" or wedge shape form. Gas above the pressure of ambient atmosphere enters the nozzles 35, 35' at an upstream location and exits via the slot shaped openings 37, 37' in their base. Said gas is caused to be emitted normal to their wedge shape and directed approximately tangent to the surface of the "porous" material. As the liquid surface film is carried upward, it encounters this gaseous stream which causes said film to be displaced along the "porous" material surface, leaving only the free liquid films to be ruptured by the impinging gaseous stream. The flow path thus taken by the liquid surface film is indicated by the arrows in FIG. 7. The "V" or wedge shape therefore functions to emit the gas in such a way as to cause the surface film to flow along its "crest".

In an experimental arrangement utilizing a pair of flared nozzles similar to those shown in FIGS. 6 and 7 with a disc shaped apparatus similar to that shown in FIGS. 3 and 4, it was observed that the surface film was completely displaced upon encountering this gaseous stream, leaving only free film in the interstices of the "porous" material. It was also observed that there was no noticeable build-up of liquid along the "crest" of the gas stream but instead was seen to flow around the nozzles in a path similar to that shown by the arrows in FIG. 7. Low gas pressure (in the order of 5 p.s.i.g.) was sufficient to control the surface film at moderately low speeds of the "porous" material. However, as the speed was increased the gas pressure also had to be increased in order to effectively displace the greater quantity of liquid surface film now encountering the gas stream. These tests demonstrated that this method of surface film removal produced very satisfactory results.

The flared type nozzles of FIGS. 6 and 7 would not constitute an appropriate design for the disc shape apparatus of FIGS. 3 and 4. With this configuration, the portion of the liquid surface film which is displaced toward the center of the disc will thereafter tend to flow outward by action of the centrifugal force imposed by the rotating "porous" material. If the rotational speed is high, then this liquid could possibly move sufficiently outward to again lie within the path intercepted by the impinging gaseous medium stream. As a means of circumventing this problem, the base of the nozzles 35, 35' would not have a "V" or wedge shape but a shape which is both straight and inclined to the path of motion of the disc; i.e., the edge of its base would lie along a chord of the disc. This can be visualized more clearly if one were to take the flared nozzles of FIGS. 6 and 7 and hypothetically remove half of the nozzle by cutting along its centerline as viewed in FIG. 7. The remaining half portion would now be positioned on the apparatus such that the bisected edge (original centerline) would form a right angle to that radius of the disc (fixed in space) where the surface film is to be diverted. The bisected edge would be the closest portion of the nozzle to the hub of the disc and would commence within the nonwetted projected area of the rotating "porous" material (that circular area projected by that portion of said material not traversing the liquid in the reservoir). The issuing gaseous stream will then cause all of the liquid surface film to be diverted upward toward the periphery of the disc along the inclined gas stream profile. In this manner none of the liquid surface film will encounter the impinging gaseous medium and will remain concentrated on the periphery (rim) of the disc.

During all of the tests conducted, observation was made of the uniformity and fineness of the spray. A simple means was employed since measuring equipment was not available and consisted of purely visual inspections. The spray was illuminated by a flood lamp and a dark background was provided behind the spray; i.e., the spray was between the lamp and the dark background. At low speeds of the apparatus, it was difficult to discern whether a spray existed as the spray quality was quite fine. However, by placing one's hand in front of the spray for any length of time, the hand became wet. At increased speeds, the spray was discernable as it was now of greater density. Here it was found to resemble a mist or fog of totally uniform appearance and void of any large particles. A flat piece of glass was then traversed across the liquid spray and held up to a light source for inspection. It was found that the glass was uniformly covered with very small liquid particles, similar in appearance to the crystal of a watch when held momentarily outside the window of a moving vehicle on a foggy day.

It was also found that by increasing the pressure of the impinging gas, the spherical liquid particles produced were somewhat smaller in size (finer spray). It is general knowledge that, for a given film thickness, the greater the rupturing force the finer is the resulting spray; as is the spray obtained by direct formation of droplets. In conventional two fluid atomizers the liquid is first torn into ligaments before the liquid droplets are formed and, as such, does not produce as good a quality of spray distribution and uniformity (same size spherical droplets) as when the droplets are directly formed.

Figure 9:
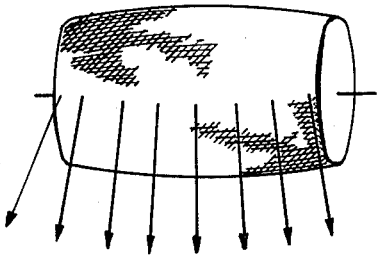
FIG. 9 is a pictorial view of the "porous" material, illustrating a gross surface form in a shape similar to, or that of, an ellipsoid.
Figure 8:
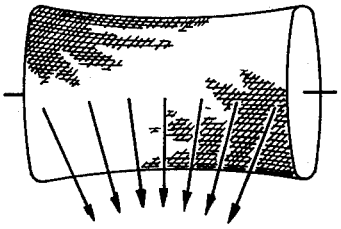
FIG. 8 is a pictorial view of the "porous" material, illustrating a gross surface form in a shape similar to, or that of, a hyperboloid of one nappe.
Figure 10:
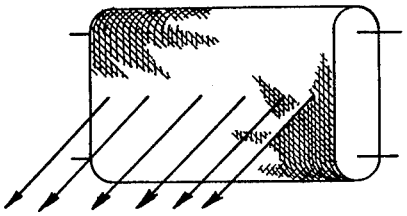
FIG. 10 is a pictorial view of the "porous" material, illustrating a gross surface form in the shape of a continuous belt.

While only two "porous" material surface shapes have been illustrated and described, it is obvious that a great number of other surface shapes can be used to accomplish the same effects. In general, a "porous" material which can be adapted into a rotatable or turnable form and whose overall surface conforms to a smooth and continuous close path can find application herein. Such surfaces will have a form lying within the general classification of geometric surfaces characterized by planes, cylinders, hyperboloids, ellipsoids and paraboloids, just to name a few, and combinations and modifications thereof. As an example of the possible use for some of these other shapes, consider the case when it is desired to produce a converging spray for a special application. Here a "porous" material possessing a gross surface shape in a form similar to, or that of, a hyperboloid might therefore be considered. Such form is shown pictorially in FIG. 8 where it is seen that the arrow lines eminating from its surface form a converging pattern. These arrow lines are representative of the particle spray that would be produced by the gross surface shape of FIG. 8. If instead it were desired to produce a diverging spray, a "porous" material possessing a gross surface shape in a form similar to, or that of, an ellipsoid might be considered. FIG. 9 pictorially illustrates such form where now the arrow lines, representative of the particle spray, are seen to diverge. If limitations of space or configuration are factors in a design, one might need to consider an adaptable combination of geometric shapes such as that shown in FIG. 10. This figure pictorially illustrates a "porous" material possessing a gross surface shape in the form of an endless belt wherein the cylinder and plane combine to form such belt shape. In this case said material would have to possess sufficient flexibility in order to move along such belt-shape path. The arrow lines in this figure are representative of a uniform particle spray.

Having described an apparatus and several modifications thereof, a brief description of its applicability to automotive carburetion and ensuing advantages follows herewith.

The objects of any fuel metering system are to atomize and distribute the fuel throughout the air in the cylinder or combustion chamber while maintaining prescribed fuel-air ratios. In order to accomplish these objectives, a number of functional elements might be required within the system:

a. Metering elements to supply a measured amount of fuel at the rate demanded by the speed and load of the engine.
b. Metering controls to adjust the rate of the metering elements for changes in load and speed of the engine.
c. Mixture controls to adjust the ratio of fuel rate to air rate as required by the load and speed.
d. Ambient controls to compensate for changes in temperature and pressure of the air that affect the elements of the system.
e. Mixing elements to atomize the fuel and mix with air to form a homogeneous (combustable) mixture.

It will be shown, in what follows, that the present invention has the capability of accomplishing the aforementioned objectives and, in fact, can accomplish these objectives by utilizing a number of functional elements which operate to produce the same effects as the above mentioned elements.

The present invention can be utilized to spray liquid fuel directly into the inlet air stream of the engine. This however may create distribution problems as the particles could possibly remain concentrated on that side of the air stream from whence the spray is admitted. A preferred method would be to have the spray first enter a distribution chamber or conduit and then be admitted into the inlet air stream by appropriate connecting passageways. Said passageways could then be arranged to have the fuel particles enter the air stream at more than one location for optimum distribution and mixing.

The atomospheric air inducted by the engine can be made to pass through a venturi nozzle, similar to the main venturi of a conventional carburetor. The venturi depression could then be utilized to aid in "pumping" and distributing the fuel spray into the main air stream (mixing element).

The requirement for the quantity of fuel delivered is essentially dependent upon engine load as can be sensed by intake-manifold vacuum, engine speed, and inlet air temperature. Depending on the load and speed of the engine and the inlet air temperature, the correct metering of fuel and thus air-fuel ratio can be delivered by controlling the speed of the "porous" material. If fuel metering is to be controlled solely by the speed of the "porous" material, then the indications of load, speed, and temperature must be programmed in such a manner that this information is translated into speed of the apparatus. One means of accomplishing this is by use of an electronic computer (control logic) which would program the required indicators by a number of external signals. These signals can be furnished by sensors which measure manifold vacuum, engine speed and temperature. Thus metering, metering control, mixture control, and ambient control are readily programmed. However, this is a control system in which its accuracy is determined (and thus limited) by the reliability and accuracy of the individual sensors, the electronic control unit, short-and long-term drift and wear influences, and other factors.

A more recent approach to electronic fuel control systems is to make use of a closed-loop feedback control which negates some of the above unfavorable influences and also presents the possibility of simplifying the total system by eliminating some of the individual control units. The details of this system approach may best be understood by referring to the article "Closed-Loop Feedback for Engine Self-Tuning", which appears in the March issue of Automotive Engineering, 1975. This, however, does not eliminate the unfavorable condition that its accuracy is still a critical factor as well as its production costs.

Another and preferred means of fuel control consists of utilizing in combination both methods of metering as described in this invention; i.e., by controlling the speed of the apparatus and the total gaseous-medium stream width that is permitted to impinge upon the free liquid films. By utilizing the engine's rotation as the external drive for the "porous" material, a simple mechanical arrangement can be achieved as a means of programming engine speed. One such arrangement could possibly consist of a drive belt connected to the engine's timing wheel at one end and to an appropriate drive train leading to the apparatus at the other end. Here the metering element for measuring and supplying the fuel at the rate demanded by the speed of the engine is the speed of the apparatus, which possesses positive control and accuracy.

Programming load can also be achieved by simple mechanical means. By utilizing a device for controlling the total gaseous-medium spray width and mechanically connecting such device to, say, a vacuum diaphram which senses intake-manifold vacuum, load programming is achieved. To illustrate how such a system functions to achieve load control, consider the case when there is a certain fixed speed and load on the engine and the apparatus is delivering the correct amount of atomized fuel. For matter of convenience, we shall assume that the variable area nozzle device of FIG. 5 is employed and that for the above conditions of speed and load, the nozzle is at some intermediate opening position. Now consider increasing the load on the engine while maintaining constant speed. In order to achieve this condition, the throttle valve (or whatever other device is used for controlling the amount of air-fuel mixture inducted into the engine) would have to be opened further so that a greater quantity of mixture is allowed to enter the engine. This is necessary since the power produced by the engine depends upon the mass of mixture burned. As the speed of the "porous" material will not increase so as to deliver a greater quantity of fuel in proportion to the now increased mass of air entering the engine (speed of the apparatus coupled to the speed of the engine), the variable area nozzle must then be opened further in order to achieve the air-fuel ratio demanded by the additional load. This further opening of the nozzle will occur automatically since the vacuum diaphram will change its position upon sensing a different intake manifold vacuum as a result of the new throttle valve setting. Thus load control is achieved by means of the gaseous medium emitting system.

Basically the speed and load controls of the apparatus would function so as to always deliver the correct air-fuel ratio demanded by the engine. That is, at any speed-load combination, the aforementioned controls would self adjust in such a manner as to maintain a practically constant air-fuel ratio — most desirable from the standpoint of economy and pollution control.

In a manner similar to that used to achieve load control, ambient controls can also be achieved. A rather simple arrangement would be to employ a thermostatic spring for sensing inlet air temperature in which the movement of this spring can be used to further control the total gaseous-medium stream width. With this concept, an overriding mechanism to the load control system should be used so that the total gas stream width, and thus air-fuel ratio, is changed accordingly. This will therefore enable the engine to receive an additional amount of fuel (rich mixture) for starting when the engine is cold and on low temperature days when the air density is high (here a greater mass of air is inducted per revolution of the engine). It should be noted that a rich mixture for cold starting is normally needed with conventional carburetors because of the need to make up for all the fuel that plates out on the manifold walls and does not vaporize fast enough to burn inside the cylinders. With the present invention it is expected that only a very moderate rich mixture will be needed since the fine particles produced will not only diminish the amount of fuel that plates out but will also aid in its vaporization.

A throttle plate on the downstream side of the carburetor can profoundly influence the distribution of fuel to the cylinders. At part throttle it has the affect of diverting the flow towards the wall of the manifold. In addition, flow passing the throttle plate sets up a low pressure region on the underside of the trailing edge, tending to deflect fuel particles towards those cylinders feeding from this region. This can be avoided if the throttle plate were located upstream of the carburetor. Of significance is the realization that the present invention can find means which will allow the latter arrangement without appreciably affecting its operation, but the same is not true for the conventional carburetor.

Compensation for inlet air pressure, which affects the air density and thus the mass of air inducted per revolution of the engine, can be achieved in a manner similar to that used to achieve temperature control. If the ambient air pressure were lowered as when driving at high elevation, the mass of air inducted per revolution of the engine would be less than that at a lower elevation and the air-fuel ratio would thus change. In order to maintain the required ratio, the mass of fuel sprayed into the manifold would have to decrease. One possible arrangement would be to use a hermetically sealed bellows containing a gas which assumes the same pressure (and temperature) as that of the entering air; i.e., the contraction or expansion of the gas and the corresponding movement of the bellows will depend on the air density. By suitable design, the motion of the bellows can be used to change the setting on the variable spray width device and thus achieve the proper air-fuel ratio. As with the temperature control mechanism, an overriding mechanism might likewise be used.

In conventional carburetors, there is always a fairly large amount of liquid fuel moving along the manifold walls mainly due to poor atomization. Also large liquid particles tend to strike and collect on the throttle plate with the result of flowing off the plate in a stream and onto the manifold walls. The air and evaporated fuel take much less time than the liquid streams and large droplets to get from the carburetor to the cylinders. Under equilibrium conditions, however, the same amount of fuel and air per unit time enters the engine as leaves the carburetor. When a sudden increase in power is required (as when accelerating) and the throttle is quickly opened, all the additional air and evaporated part of the additional fuel supplied reach the cylinders almost immediately. However, the unevaporated part of the additional fuel may not reach the cylinders for several seconds after the throttle is opened. This resulting temporary lean mixture prevents the engine from developing full power at a time when it is most needed. This condition is avoided by incorporating an accelerating pump in the carburetor which injects a large amount of fuel into the inlet manifold upon quickly opening the throttle. A sufficient quantity of fuel is now atomized and evaporated to give the proper air-fuel ratio for maximum power operation and consequently consuming more fuel then would otherwise be needed.

With the present invention not only is quick response possible but the fine degree of atomization and subsequent evaporation of the fuel will alleviate a large percentage, if not all, of the above problems. Hence, when sudden power increase is demanded, little or no extra fuel is required in proportion to the inducted air and the air-fuel ratio will remain essentially unchanged from that of the cruising (economy) range.

The main metering system of present day carburetors not only fails to give a required rich mixture at low air flows (as when idling), but also fails to deliver any fuel whatsoever. A rich mixture is needed during idling since the incoming charge experiences a large percentage of exhaust gas dilution due to valve overlap and poor atomization at low air velocities. An additional idling or low-speed fuel metering system is therefore required to compensate for this defect in the main metering system. These problems would not exist with the present invention since fuel would always be delivered at any speed of the engine and in fine atomized form. The required rich mixture under low-speed conditions can always be secured with the main metering system. A means for obtaining this rich mixture when using, for example, a device similar to the variable flow area nozzle of FIG. 5 is to control the nozzle opening (theposition of the vanes in FIG. 5) by means of a vacuum diaphram at high vacuum pressures, which are the pressures experienced during idling and deceleration — deceleration produces problems of a similar nature. The diaphram would function to prevent further closing of the nozzle after a predetermined vacuum pressure was sensed, and thus produce proportionately richer mixtures as the vacuum increases beyond this value. Hence the apparatus is capable of delivering the required rich air-fuel ratios by proper design of the gaseous medium emitting system.

As a result of the relative simplicity of mechanical control as pertains to the present invention, there obviously exists a number of distinct advantages over electronic control. Some of these advantages are greater reliability and accuracy, lower manufacturing costs, simplicity, and virtually little or no maintenance.

One of the principle advantages of the present invention is that it can efficiently be used as a carburetor for lean-burn engines. By burning of the fuel in the lean mixture two distinct advantages are produced: better fuel economy and cleaner emissions. Auto engineers have known for some time that if they could run engines lean enough they would be operating at a point where the significant pollutants are at or near a minimum production. An engine can run quite lean if it can get exactly the right mixture in all of its cylinders. This seems impossible with current carburetor technolgy of the conventional type but the same is not true of the present invention: good distribution and uniformity are its prime characteristics. Its highly effective atomization provides excellent distribution because the fuel stays uniformly suspended in the air.

When considering large fuel particles, they need relatively long times to fully vaporize all of the fuel and time is the missing element in todays high rpm engines. Small particles, however, exposes more surface area to the fuel by dividing the fuel into smaller particles, provides a more homogeneous mixture, and offers a better chance for full combustion in the allotted time span. Therefore, there is no need to supply an excess of fuel to the cylinders. The lean air-fuel ratios, in turn, do not require expensive catalytic converters to burn off pollutants which results in further fuel savings. This fuel saving occurs since catalytic converters need more fuel (rich mixture) just to keep them "hot" for effective operation.

The current crop of electronic ignitions is due in a large extent to the difficulty of insuring ignition with a lean mixture as provided by conventional carburetors. However when the fuel particles are smaller in size, there is a greater reliability of insuring ignition since a larger degree of homogeneity would then exist.

Information provided by developers indicates that burning a lean mixture produces lower combustion temperatures which correspondingly lowers the amount of nitrous oxides formed. In addition, the mass of a small fuel particle is more easily vaporized and, therefore, burns more "cleanly" with less carbon monoxide and hydrocarbon by-products. Further, the ability to raise the compression ratio and use leaded fuel are extra bonuses of a lean-burn engine (raising the compression ratio increases efficiency).

A further means of utilizing the present invention for automotive carburetion is by having all of the incoming air charge pass through the gas emitter for controlling the quantity of air flow inducted while at the same time act as the impinging gaseous medium. The air-fuel mixture resulting from the rupturing of the free fuel films would then be admitted into the engine via the intake manifold. Of prime consideration is that now the distribution of fuel particles will be quite uniform since the incoming air charge directly mixes with the atomized fuel particles at their source. This therefore will eliminate the need for special mixing chambers and admitting passageways. In addition, if the gas emitter is in the form of a sonic nozzle having a controllable flow passage, then means are available for controlling the quantity of air inducted and for automatically metering the correct amount of fuel. Then the need for a throttle valve, and all its disadvantages, is eliminated as well as the need for special fuel metering devices and systems. The means whereby the aforementioned conditions can be accomplished are described herein and, specifically, in what follows.

In the above system, then, atmospheric air enters the upstream side of the sonic nozzle via a plenum chamber or conduit and exits downstream into an atmosphere corresponding to intake manifold conditions. By means of example, consider adapting the cylindrical configuration of FIGS. 1 and 2 to this application. The apparatus would now be completely enclosed within a housing and placed in communication with the engine's intake manifold for ingesting the resulting air-fuel mixture charge. As the sonic nozzle would now be affixed to the plenum chamber 10 at the location of the aperture 11, the interior of said housing and therefore the downstream side of the nozzle would be exposed to manifold conditions. Air would now enter the chamber 10 via conduit 12 (preferably two conduits, one on either side of the chamber) having its upstream aperture opened to the atmosphere. Air is then caused to flow through the apparatus as a result of manifold vacuum and hence the need for a pressurized air source is eliminated.

A sonic nozzle falls into the category of converging-diverging nozzles. The entrance side narrows down to a throat, at which point the passage grows wider again as it approaches the exit. While more than one configuration of a sonic nozzle can be designed, a venturi shape configuration will herein be used as a means of explaining the basic principles and operation of a sonic nozzle. An appropriate design in this case, then, is a nozzle having a rectangular cross section and fitted with movable side walls conforming in profile to the venturi shaped flow passage for varying the flow area. The nozzle of FIG. 5 can also be considered a form of sonic nozzle where the directional vanes 33,33' would have an inner profile in the shape of a venturi, the only difference being that now the side walls remain fixed in position while the venturi shaped walls (vanes) move. Movement of these walls (vanes) can be made to occur in a lateral direction and therefore should not be considered limited to only pivotal motion as shown in FIG. 5.

For specified values of Mach number, pressure, temperature, and area at the upstream section of a sonic nozzle, the mass flow rate through the nozzle is specicied and there is a maximum contraction which is possible. This contraction corresponds to sonic velocity at the throat, or stating it differently, there is a minimum cross-sectional area required to pass this flow. This phenomenon is called choking and is achieved by having the ratio of throat to inlet pressures equal to, or less than, the critical pressure ratio for air.

When the engine's piston descends on the intake stroke, the pressure in the cylinder and manifold will fall below atmospheric pressure, forcing air to flow through the nozzle. If there were no restriction to this air flow, the maximum weight of air would fill the cylinder and full load or maximum speed would be achieved. At part load there must be a means of restricting the quantity of air inducted and the conventional carburetor uses a throttle plate for this purpose. Here, however, said nozzle acts as both a throttle and gas emitter so that the required restriction of air flow at part throttle is provided by the nozzle itself.

If the nozzle is now designed to operate under choked conditions, simple means for metering the fuel are achieved and further simplifications and advantages ensue. What happens as the air passes through the nozzle is that it first accelerates in the converging portion and reaches sonic velocity (the local speed of sound) at the throat as the pressure continues to fall. In the diverging portion, several things can happen to the flow depending upon the back (manifold) pressure. When this back pressure is at a value which has just caused the throat pressure to reach its critical value, the air decelerates and the pressure rises to the back pressure at the exit plane of the nozzle. If the back pressure is raised above this critical value, the nozzle acts like a conventional subsonic venturi and the flow is no longer choked. In this case, the mass flow very much depends upon the back pressure. If now the back pressure is lowered below that value which just gave sonic flow in the throat, the fluid accelerates to supersonic velocities and before leaving the diverging section of the nozzle the flow shocks back to subsonic speeds (i.e., the fluid experiences a sharp "discontinuity" in the flow). Here the flow is at its choked value and does not depend on the back pressure.

In designing the nozzle, the angle for the diverging section is chosen such that sonic conditions prevail at the throat while maintaining subsonic flow in the diverging section. This will provide for an efficient operating design point. With the present invention it becomes possible to have an engine operate at a constant and lean air-fuel ratio over essentially the entire range of speed and load. The extraordinary advantages to this have been previously discussed in this invention. By operating the nozzle in the choke condition allows the mass air flow to be controlled by the nozzle's flow area. Hence the quantity of air delivered is directly proportional to the throat area as long as the inlet pressure and temperature stay constant, which they pretty well do in normal driving. This in turn means that fuel is required in direct proportion to the throat area also. If we now rotate the "porous" material at a constant speed by a small electric motor, then the quantity of fuel delivered will vary directly with nozzle flow area since the width of the air stream rupturing the free fuel films is directly proportional to this area. The flow area, in turn, is controlled by the movable side walls of the nozzle. This, then, provides a very simple means for metering the fuel.

To get a further insight on how just such a system will accommodate the various operating ranges of the engine, consider following a vehicle through different modes of operation. Assume the vehicle is operating in the cruise mode at constant speed and load. The manifold (back) pressure is at a value which just sustains sonic conditions in the throat and we come upon a hill where it is desired to maintain constant speed. Here we must increase the flow of air and fuel to the engine by further opening the nozzle (flow area). As the speed is held constant, the back pressure and throat pressure will tend to rise above the critical value so that the flow through the throat is no longer choked. This, in effect, causes the air flow rate to increase at a slower rate than the rate of area increase—air flow is no longer proportional to only nozzle area. The shifting from the critical pressure ratio is expected to be moderate since the increased air flow has the countereffect of lowering nozzle pressures. The overall effect, then, is a resulting enrichment in the air-fuel mixture which can be beneficial under high load conditions.

Should it be found that excessive amount of shifting occurs with respect to the air-fuel ratio, then the speed of the "porous" material must be lowered to accommodate a more constant air-fuel ratio; i.e., within tolerable design limits. Here we can control the speed of the electric motor by rather simple means. For example, a pressure transducer coupled to an electronic computer or a rheostat actuated by a vacuum diaphragm can be employed for changing the input current to the motor and hence its speed. If the rheostat-diaphragm arrangement were employed, which is the preferred method on the basis of reliability and cost, one side of the diaphragm would be placed in communication with the plenum chamber (upstream nozzle pressures) and the other side in communication with the throat of the nozzle (throat pressures). As the upstream pressure is essentially constant, a raising of the throat pressure above the critical value would cause the diaphragm to move. By linking the diaphragm movement to a rheostat, the motor speed can now be lowered a corresponding amount. Hence the air-fuel ratio will remain within appropriate design limits.

The nozzle could be designed to operate in the supersonic range so that a moderate raising of the back pressure does not unchoke the flow. This, however, creates losses due to shocking in the diverging section and the efficiency of the nozzle is lowered, causing the efficiency of the engine to be lowered accordingly.

If now the vehicle is on a level road after coming over the hill, but the nozzle opening is unchanged from the above setting, the speed of the engine will increase as the load has now been reduced. This will cause the manifold pressure to lower as the mass flow of air increases until a choking condition is once more resumed. At this point no more air can enter the engine and the speed will level off. This will then return the air-fuel ratio back to its optimum setting as well as the nozzle's optimum operating conditions.

The sequence of events described above is exactly what would occur while in the acceleration mode. While the speed of the vehicle does not remain constant here, the initial opening of the nozzle when putting the vehicle in this mode does not instantaneously increase the speed of the engine due to inertia effects. The initial phase of acceleration, then, corresponds to those conditions created by the vehicle when moving uphill at constant speed.

If now the vehicle is put in a deceleration mode by letting up on the accelerator (decreasing nozzle flow area), the back pressure and air mass flow decreases but not the air-fuel ratio; i.e., the optimum air-fuel ratio is maintained. This must happen since a lowering of the back pressure will not affect the choked conditions at the throat and fuel and air is delivered in direct proportion to nozzle flow area. The flow does however enter the supersonic flow regime with subsequent shocking to subsonic velocities. This shocking and the resulting pressure loss can be prevented by employing a solenoid valve to control the rate of nozzle closing. In this way sufficient time is allowed for the vehicle to decrease in speed so as to keep the back pressure essentially at the optimum setting. The solenoid valve can be of the same type presently used on conventional carburetors to prevent "dieseling".

At slow speeds (idle mode) when a rich mixture is necessary, the speed of the electric motor and thus "porous" material can be increased by programming engine speed. It is a rather simple matter to have idle speeds sensed and translated to "porous" material speed.

As the mass of air flow through the nozzle is inversely proportional to the square root of the inlet temperature, it becomes necessary to keep this temperature at its design value. Here, temperture control can be achieved in a manner similar to that used on conventional carburetors; i.e., by means of an air inlet temperature valve. However during warm-up periods when the temperature valve is ineffective, the mass of air passing through the nozzle becomes disproportionate to the fuel flow and a lean mixture ensues. This can cause the engine to misfire and stall. To compensate for the leaning-out of the mixture under these conditions, the inlet air temperature can be sensed and means provided for causing the speed of the electric motor and thus "porous" material to increase accordingly.

Driving at altitude, the mass air flow through the nozzle will be different than at sea level since mass flow is directly proportional to inlet air pressure. The air-fuel ratio will therefore change if means are not provided for compensating for changes in inlet pressure. Here means can be provided for sensing inlet air pressure and the resulting signal (mechanical or electrical) translated to changes in "porous" material speed so that the correct air-fuel ratio will be maintained.

The various off-design signals discussed above and which are produced as a result of compensating for changes in inlet pressure and temperature, lean idle mixtures and, when found to be necessary, air-fuel ratio shifting during acceleration, can be programmed electronically so that the correct signal is delivered to the electric motor or, if desired, mechanically by means which will now be discussed. Using mechanical means, then, each of the various signals produced can be used to cause the movement of linkages which, in turn, would cause a change in the current delivered to the drive motor through proper means. A simple means of causing current and thus speed changes in proper combination is with the use of rheostats connected in series. Each rheostat would then be directly coupled to the different linkages so that each signal controls only one rheostat. The total effect then is a resulting single electric signal delivered to the drive motor to change its speed exactly that amount to properly compensate for the combined off-design effects.

While a particular configuration of the disclosed invention as pertains to automotive carburetion is not shown due to statute limitations, there obviously exists means for adapting it to such uses as delineated in the foregoing descriptive material.

Although the present novel invention has been described herein with a certain degree of particularity, it is understood that the present disclosure has been made only by way of example and that numerous changes in the details of construction and the combination and arrangement of parts may be resorted to without departing from the spirit and the scope of the invention as hereinafter claimed.

What is claimed is:

1. An apparatus for dispersing liquids into a gaseous medium in the form of a mono-dispersed spray having capacity to control the quantity of liquid dispersed comprising, in combination, a liquid receiving receptacle, an elongated free film rupturing gas emitter, a rotatable cylinder accommodating a mono-layer "porous" material adapted for conveying liquid from said receptacle to the proximity of said gas emiter, and a surface film removing means for completely removing surface film from said "porous" material prior to having said material in the proximity of said gas emitter, said surface film removing means including means providing a pair of directly opposed wedge like nozzles providing a wedge like slotted opening adapted to emit a wedge like fluid stream substantially tangentially with respect to said material and toward said surface film; means for supplying a liquid to said receptacle, said means including means regulating flow into said receptacle at a rate sufficient to maintain contact with said "porous" material moving in said receptacle; means comprising the characteristic of the "porous" material acting on the liquid to form thin, stressed free films in the openings of said material upon emerging devoid of surface film from the liquid in said receptacle, and upon completely removing surface film from said material by said removing means whence containing surface film thereon; means for introducing a gaseous medium to the interior of said gas emitter at a pressure above ambient pressure acting on the outside of said gas emitter whereby said medium is caused to be emitted outwardly from the interior of said emitter and directed substantially perpendicular to the "porous" material and transverse to the direction of said material travel with sufficient energy to further stress said films to the point of rupture, thereby producing minuscule particles of liquid which are dispersed therefrom in the form of a spray; wherein the quantity of liquid dispersed is controlled by means of controlling the speed at which the "porous" material moves, by means of controlling said free film rupturing gas emitter stream width in the direction transverse to the direction of said material travel, and by means of the two foregoing means for controlling the quantity of liquid dispersed.

2. An apparatus as defined in claim 1 wherein the conveying of liquid is effected by adapting the "porous" material in the form of a rotating hollow hyperboloid, and forms similar thereto, having its lower periphery disposed within and in contact with the liquid in said receptacle.

3. An apparatus as defined in claim 1 wherein the conveying of liquid is effected by adapting the "porous" material in the form of a rotating hollow ellipsoid, and forms similar thereto, having its lower periphery disposed within and in contact with the liquid in said receptacle.

4. An apparatus as defined in clain 1 wherein the conveying of liquid is effected by adapting the "porous" material in the form of a turning endless belt having a portion thereof disposed within and in contact with the liquid in said receptacle.

5. The apparatus as defined in claim 1 wherein the means providing a pair of directly opposed wedge like fluid streams directed substantially tangentially with respect to said material and toward said surface film comprises a pair of elongated nozzles each providing a wedge like slotted opening, said nozzles conforming to the "porous" material form so that said fluid stream discharging therefrom completely displaces the approaching surface film to the sides of said stream whereby said film is caused to flow along the "porous" material in essentially two directions while being displaced thereon.

6. The apparatus as defined in claim 1 wherein said elongated free film rupturing gas emitter comprises a plenum chamber having an elongated aperature in the surface of said chamber for discharging a gaseous medium introduced therein via said aperture.

7. The apparatus as defined in claim 1 wherein said elongated free film rupturing gas emitter comprises an elongated nozzle having a longitudinally controllable discharge orifice area for varying the width of the gaseous medium stream discharging therefrom in the direction transverse to the direction of said "porous" material travel and thus controlling the quantity of liquid particle spray dispersed.

8. The apparatus as defined in claim 7 wherein longitudinal control of said discharge orifice area is effected by a pair of opposed directional vanes movably mounted within said nozzle for differential movement (in opposite directions) in the longitudinal direction of said nozzle.

9. The apparatus as defined in claim 8 wherein said directional vanes are pivotally mounted within said nozzle for differential rotational movement therein.

10. The apparatus as defined in claim 8 wherein said directional vanes are slide mounted within said nozzle for differential translational movement therein.

11. The apparatus as defined in claim 1 wherein said elongated free film rupturing gas emitter comprises an elongated sonic nozzle having a convergingdiverging rectangular flow passage wherein the cross sectional flow area of said passage is longitudinally controllable for varying simultaneously and proportionately the quantity of gaseous medium discharging therefrom and the width of said gaseous medium stream in the direction transverse to the direction of said "porous" material travel, thus controlling proportionately the quantity of liquid particle spray dispersed to the quantity of said gaseous medium flowing through said nozzle.

12. The apparatus as defined in claim 11 wherein longitudinal control of said cross sectional flow area is effected by having the transverse walls (vanes) of said nozzle slide mounted for differential (in opposite directions) translational movement therein.

* * * * *